US005333333A

United States Patent [19]

Mah

[11] Patent Number: 5,333,333

[45] Date of Patent: Aug. 2, 1994

[54] TRANSPORTATION, SANITATION AND THERAPY SYSTEM FOR HANDICAPPED PEOPLE

[76] Inventor: Gordon B. J. Mah, P.O. Box 431, Palo Alto, Calif. 94302

[21] Appl. No.: 1,307

[22] Filed: Jan. 6, 1993

[51] Int. Cl.[5] ..... A61G 7/10

[52] U.S. Cl. ..... 5/81.1; 5/86.1; 297/5; 297/DIG. 4; 280/250.1; 280/304.1; 280/30

[58] Field of Search ..... 5/81.1, 83.1, 84.1, 5/86.1, 87.1, 89.1; 414/921; 212/182, 225, 257, 179, 180; 297/5, DIG. 4; 280/30, 250.1, 304.1

[56] References Cited

U.S. PATENT DOCUMENTS

| | | | |
|---|---|---|---|
| 841,702 | 1/1907 | Martin | 5/89.1 |
| 953,962 | 4/1910 | Lane . | |
| 1,878,785 | 9/1932 | Leavitt | 5/86.1 |
| 2,272,778 | 2/1942 | Reuter | 5/85 |
| 2,666,212 | 1/1954 | Flanders | 5/86.1 |
| 2,962,730 | 12/1960 | Carnes et al. | 5/86.1 |
| 3,252,704 | 5/1966 | Wilson | 5/83.1 X |
| 3,270,353 | 9/1966 | Berthelsen et al. | 5/81.1 |
| 3,778,052 | 12/1973 | Andow et al. | 297/5 X |
| 3,829,113 | 8/1974 | Epelbaum | 280/30 |
| 3,999,228 | 12/1976 | Thomas | 5/83.1 |
| 4,054,319 | 10/1977 | Fogg | 297/384 |
| 4,117,561 | 10/1978 | Zamotin | 5/83 |
| 4,141,094 | 2/1979 | Ferguson | 5/81 |
| 4,202,063 | 5/1980 | Murray | 5/81.1 |
| 4,362,311 | 12/1982 | Bergman | 280/250.1 |
| 4,530,122 | 7/1985 | Sanders | 5/83 |
| 4,571,758 | 2/1986 | Samuelsson | 5/86 |
| 4,682,377 | 7/1987 | Reich | 5/86 |
| 4,703,523 | 11/1987 | James | 5/83 |
| 4,719,655 | 1/1988 | Dean | 5/81 |
| 4,730,842 | 3/1988 | Summers | 280/638 |
| 4,737,997 | 4/1988 | Lamson | 5/81 |
| 4,999,862 | 3/1991 | Hefty | 5/81 |
| 5,165,123 | 11/1992 | Colpron | 5/83 |
| 5,187,822 | 2/1993 | Merry | 414/921 X |

*Primary Examiner*—Michael F. Trettel

*Attorney, Agent, or Firm*—Flehr, Hohbach, Test, Albritton & Herbert

[57] ABSTRACT

A system of apparatus for use with handicapped or disabled patients. The apparatus includes a mobile platform which removably mounts a patient support module which can be a chair or commode seat. Lift module means is attached to the mobile platform for lifting or lowering the patient from or to a bed or other structure. In certain embodiments a body harness is suspended by the lift module for supporting the patient upright so that the apparatus can be used as a therapeutic walking exerciser. In another embodiment, a body sling supported from the lift module provides support for the patient's arms for use as a therapeutic exerciser. The method of operation permits the apparatus, with the support module chair removed, to be moved to a position where the lift module is centered over the patient on a bed, automobile seat or other structure to facilitate lifting and transporting the patient. This method simplifies the transfer of a patient.

17 Claims, 15 Drawing Sheets

TRANSPORTATION, SANITATION AND THERAPY SYSTEM FOR HANDICAPPED PEOPLE

BACKGROUND OF THE INVENTION

1. Field of the Invention

This invention relates in general to apparatus for assisting handicapped or disabled people with transportation, sanitation or other therapy procedures.

2. Description of Related Art

More than 20% of adults over age 65 have difficulty with at least one activity of daily living (ADL) or with walking. With increased age, especially over 80 years, difficulties with ADL increases dramatically. Bathing is the most common ADL problem, followed by transferring between bed and chair, dressing, toileting and feeding.

Many devices have been invented for helping the invalid or handicapped patients in bathing, transfer between bed and chair, toileting, walking, and physical therapy. Usually, each device is designed for one specific application. For instance, there are many kinds of wheelchairs; e.g., ordinary wheelchairs and commode/-shower wheelchairs. Lifts have been used to transfer patients between bed, wheelchair, commode, bathtub, and automobile. Bath lifts and bath chair lifts are used specifically to lift patients in and out of bathtubs. Lifting systems that have a hoist mounted on a trolley, running on a rail, are used to lift and transport patients. The rail is either suspended from the ceiling, or as the top of a gantry. For physical therapeutic exercise, there are equipment available for the exercise of hand and arm, and for the legs. Also, apparatus is available to help patients walk and stand up. All the above devices are currently available on the market.

Other prior art includes U.S. Pat. Nos. 953,962; 2,272,778; 4,117,561; 4,682,377; 4,703,523; 4,719,655; 4,737,997; and 5,165,123 which were designed for lifting and transferring a patient from bed to wheelchair. U.S. Pat. No. 4,571,758 was designed for lifting and transferring. U.S. Pat. No. 4,730,842 is an adjustable wheelchair. U.S. Pat. Nos. 4,141,094; 4,530,122; and 4,999,862 provide lifting devices to be added to manual or electrical wheelchairs for lifting and transferring patients from a wheelchair. U.S. Pat. No. 4,054,319 was designed for aiding a wheelchair user to stand up.

It would be ideal to have all the aforementioned equipment readily available for the care of invalid patients, because each one of them has only limited application. Because the specialized equipment is very expensive it is unlikely that a patient will have all of them available for use. It is also extremely unwieldy to store and to manage that many pieces of medical equipment in an ordinary household—even in a modest size nursing home or hospital.

OBJECTS AND SUMMARY OF THE INVENTION

It is a general object to provide a new and improved system of apparatus and method for use in assisting handicapped or disabled people with transportation, santitation or therapy procedures.

Another object is to provide a system of apparatus and method of the type described in which a mobile platform carries a patient support device and a lift module is carried on the platform means for lifting and lowering the patient.

Another object is to provide a system of apparatus and method of the type described for use as a therapeutic exerciser in which the patient support includes a body harness which holds the patient in a standing position together with grip handles for the patient to grasp while being supported by body harness.

Another object is to provide a system of apparatus and method of the type described in which the lift module includes a hoist connected with a sling for moving the patient between a bed or other structure and a chair, commode seat or other patient support module on the mobile platform.

Another object is provide a system of apparatus and method of the type described in which the patient support is selectively detachable from the mobile platform to facilitate moving the platform closely adjacent a bed or other structure to hoist the patient therefrom, and to also permit the patient to exercise in a standing position adjacent the platform.

The invention in summary provides a system of apparatus and method which includes a mobile platform carrying a patient support as well as a lift module for lifting and lowering the patient relative to the support. The patient support is detachable from the platform and includes, in different embodiments, a chair or commode seat which can be interchanged as required. In another embodiment the support comprises a body harness which holds the patient in a walking position for therapeutic exercise. In another embodiment the patient support includes grip handles which are positioned for the patient to grasp while standing adjacent the platform for therapeutic exercise. In another embodiment a sling provides support under the patient's arms while the patient sits on the support to enable exercise of the patient's hands and arms.

The foregoing and additional objects and features of the invention will appear from the following specification in which the several embodiments have been set forth in detail in conjunction with the accompanying drawings.

DESCRIPTION OF THE PREFERRED EMBODIMENTS

Figure 16:
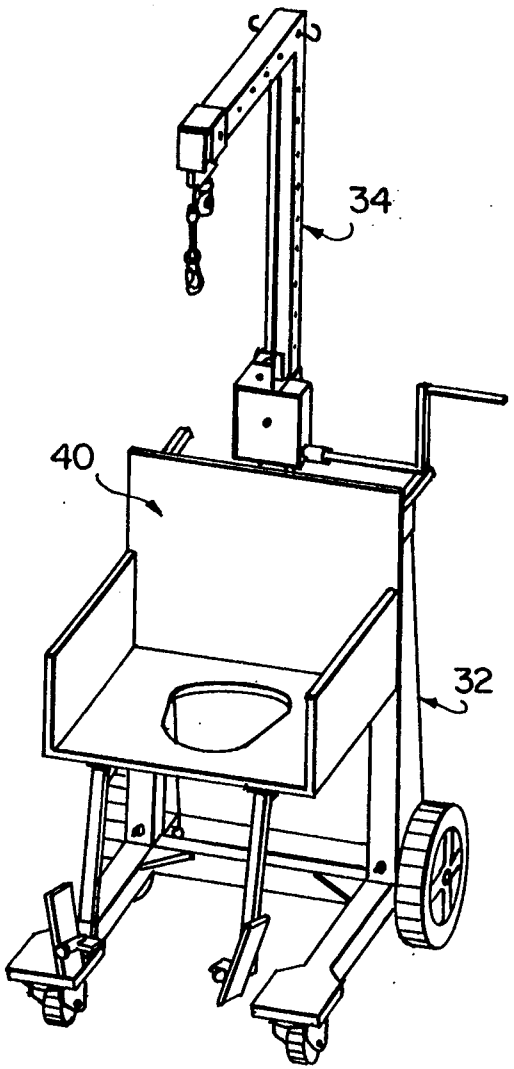
FIG. 16 is a perspective view of apparatus according to another embodiment providing a patient support module comprising a commode seat.
Figure 1:
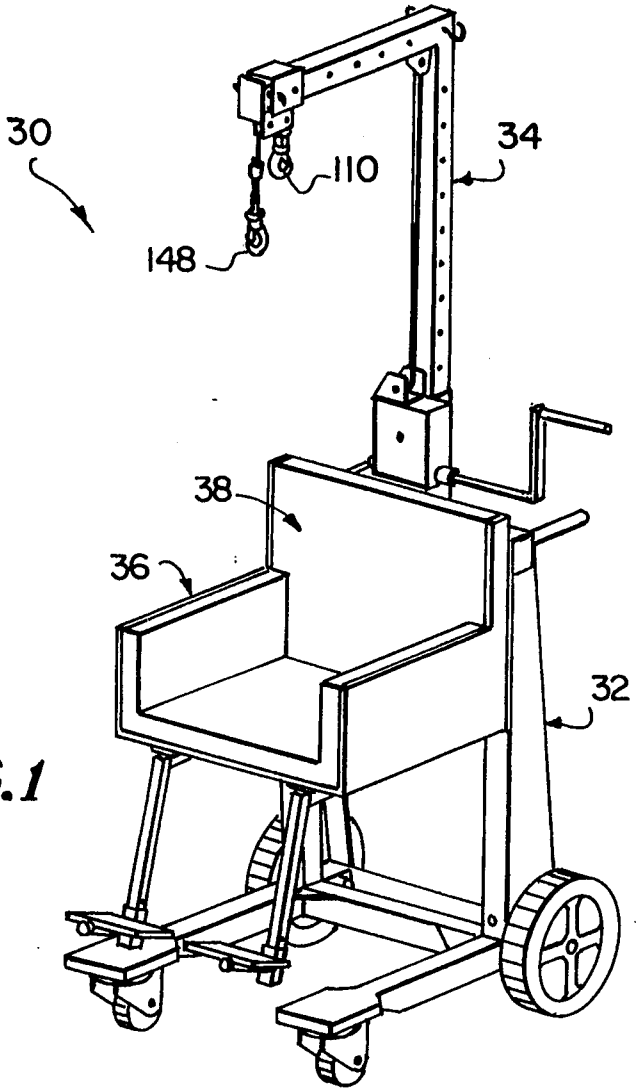
FIG. 1 is a perspective view of system of apparatus providing a combined mobile platform, lift module and patient support module according to one embodiment of the invention.
Figure 20:
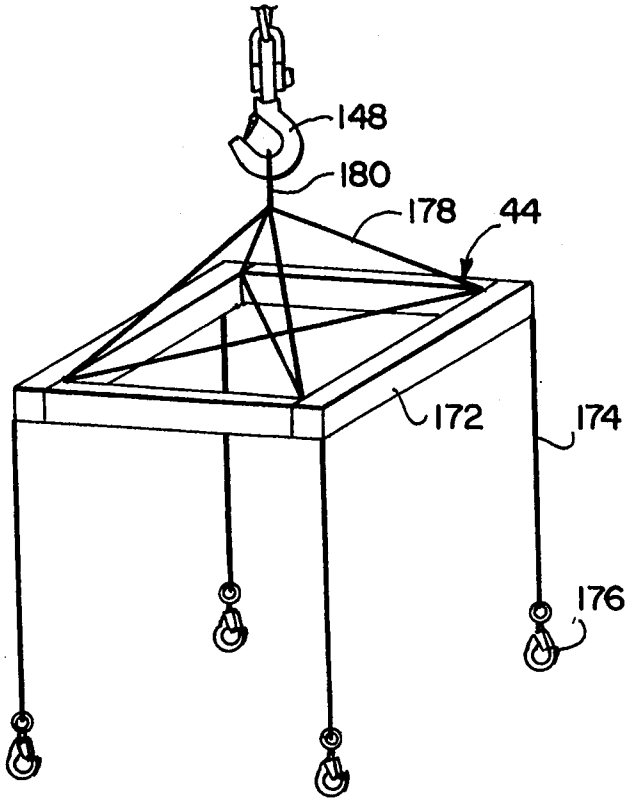
FIG. 20 is a perspective to an enlarged scale showing the arrangement for connecting the suspension frame from the lift module in the apparatus of FIG. 19.
Figure 21:
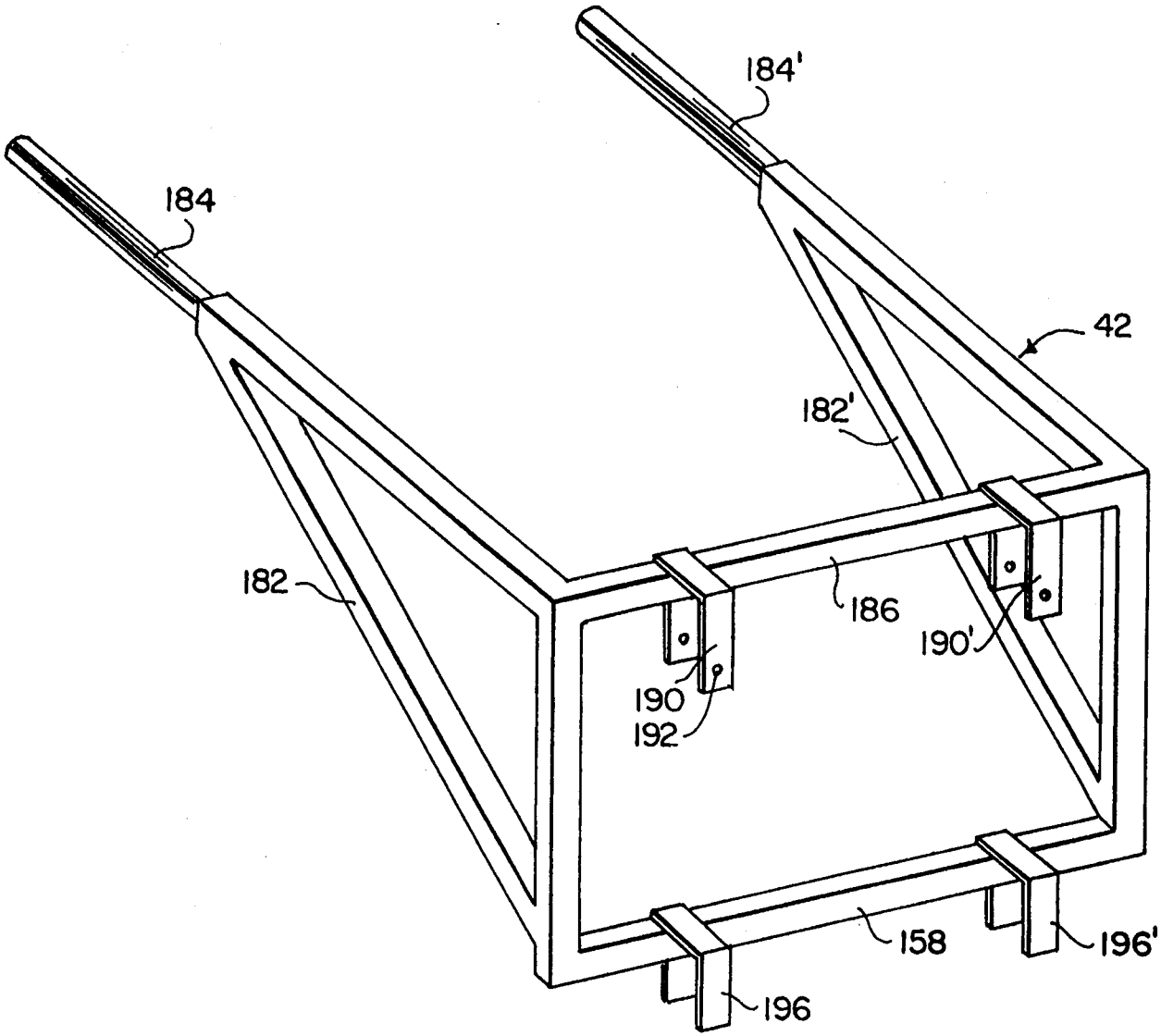
FIG. 21 is a perspective view to an enlarged scale showing the handle frame which is a component of the apparatus of FIG. 19.

In the drawings FIG. 1 illustrates generally at 30 a system of apparatus according to one embodiment of the invention. The system comprises the combination of a mobile platform 32, lift module 34 and patient support module 36. The patient support module in this embodiment is a transport chair 38 which seats the handicapped or disabled patient. The support module 36 is detachably mounted to platform 32 and is interchangeable with other patient support modules of the invention, including the commode seat 40 shown in FIGS. 16–18 or the combination handle frame 42 and suspension frame 44 as shown in FIGS. 19–21. An electrical system can be used to power the lift module as in the embodiment shown in FIG. 24.

System 30 can be adapted for a variety of useful applications by assembling the patient support modules in different combinations. For example, in the assembly of FIG. 1 the apparatus can be used to transfer a patient from a bed or other surface, such as a seat of an automobile, to the transport chair. The patient can then be transported by a mobile platform to another location. Then the patient can be lifted off the transport chair and placed on a surface. In the current practice, these sequences of transfer must be done with a wheelchair along with a separate lift. As another example, the combination of FIG. 16 with the commode seat can be used to transfer a patient from a bed or an ordinary chair to the commode chair for toileting, or to deliver that patient to a toilet. The patient can empty waste directly while sitting on the commode chair. This avoids the need for transfer of a patient between the wheelchair and toilet seat, as with the prior art apparatus. As a further example, the combination of FIGS. 19–21 with the handle frame and suspension frame can be used to move a patient from a bed to perform therapeutic exercise.

Figure 2:
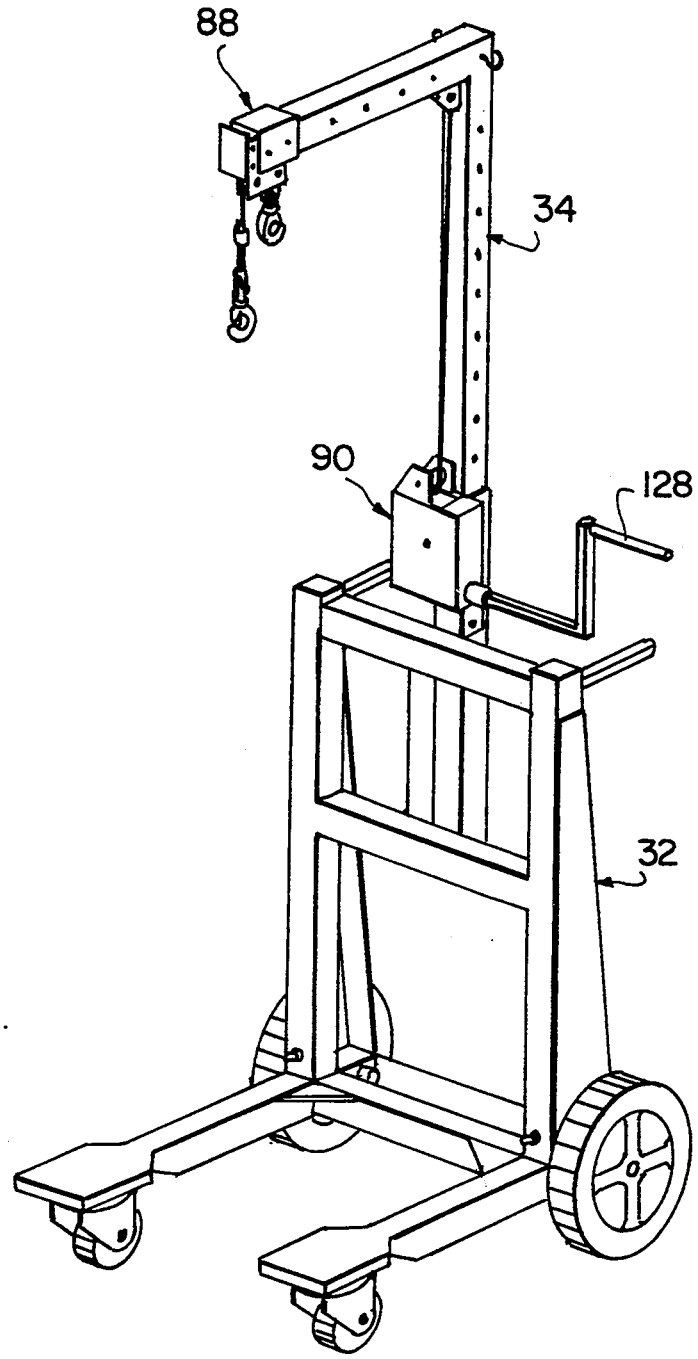
FIG. 2 is a perspective view of the mobile platform and lift module components of the apparatus of FIG. 1.
Figure 3:
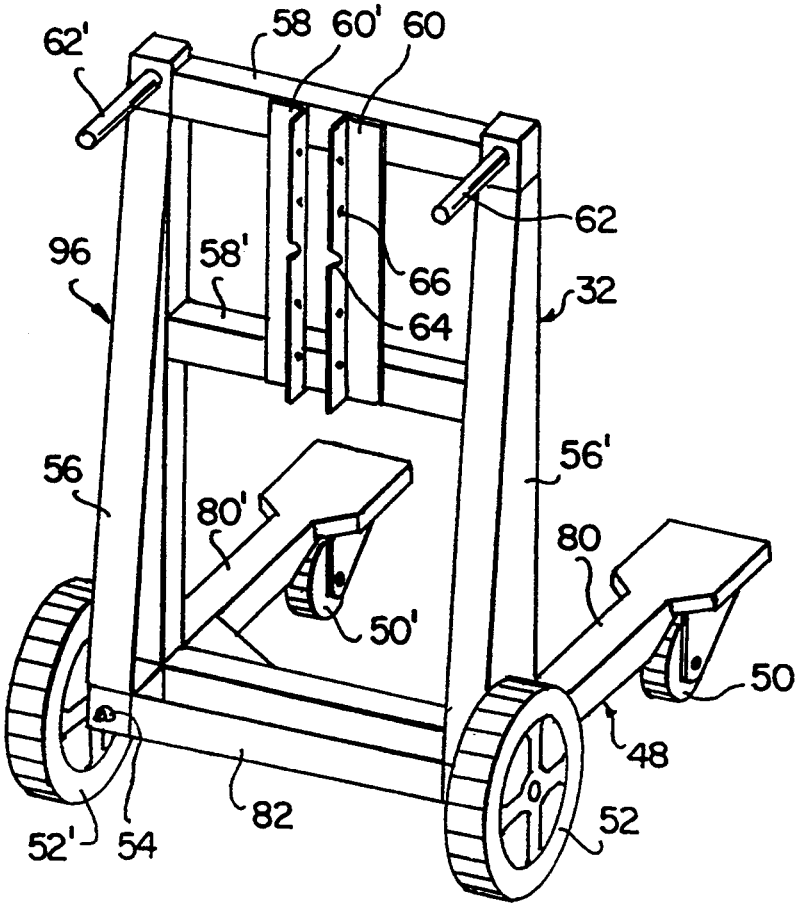
FIG. 3 is a perspective view of the mobile platform component of the apparatus of FIG. 1.
Figure 4:
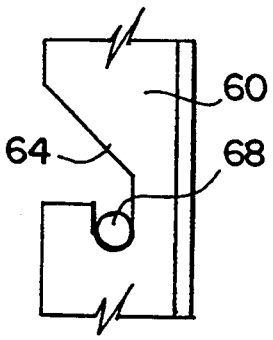
FIG. 4 is a fragmentary side elevational view to an enlarged scale of the quick release pin and notch arrangement for the platform of FIG. 3.
Figure 5:
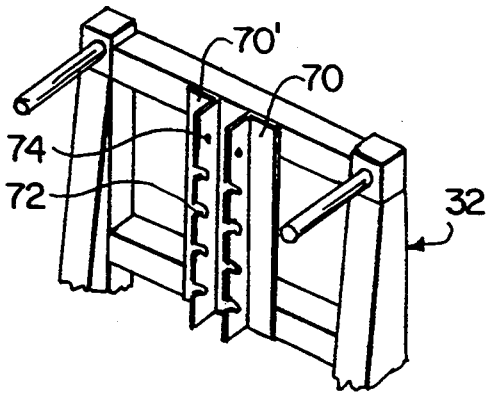
FIG. 5 is a fragmentary perspective view of another embodiment for the mobile platform shown in FIGS. 2 and 3.

FIG. 2 illustrates mobile platform 32 and lift module 34 assembled together with the patient support module disconnection. Details of the mobile platform are illustrated in FIGS. 3–5. The platform includes a vertical frame 46, chassis 48, two front casters 50, 50′ and two rear wheels 52, 52′. Quick release pins, one of which is shown at 54, are provided for mounting the vertical frame to the chassis.

The vertical frame is comprised of a pair of uprights 56, 56′, a pair of horizontal bars 58, 58′, a pair of lift supports 60, 60′ and a pair of handles 62, 62′ extending rearwardly from the top ends of the uprights. The handles are used by the caregiver to push or pull the mobile platform.

Figure 6:
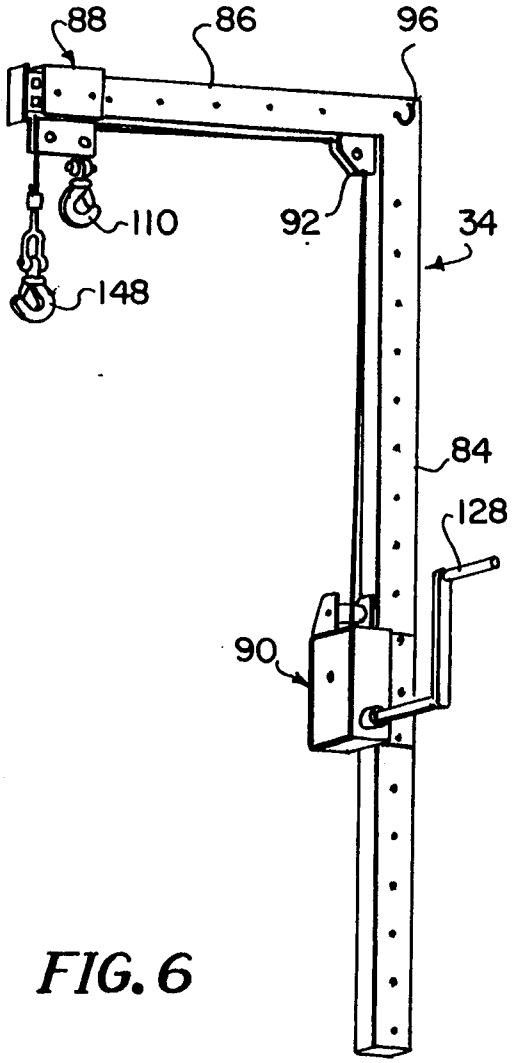
FIG. 6 is a perspective view of the lift module of the apparatus of FIG. 1.
Figure 8:
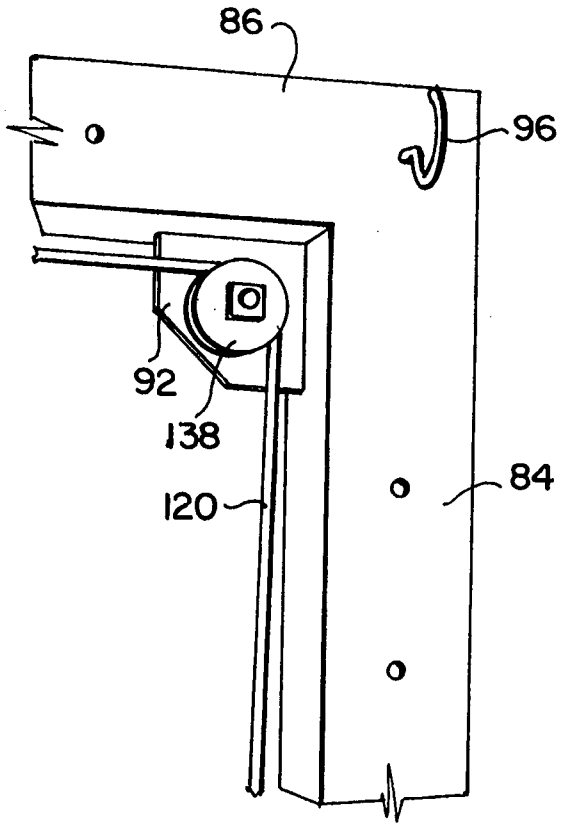
FIG. 8 is a fragmentary perspective view to an enlarged scale showing details of further components of the lift module of FIG. 6.

The lift supports 60, 60′ are provided with at least one notch 64 and one fastener hole 66; the notches and holes are symmetrical to the center line of the platform. The notches are sized and adapted to receive a quick release pin or bolt 68 (FIG. 4) which is provided for attaching the lift module to a platform. As explained subsequently in connection with FIG. 6, the lift module has a series of vertically spaced holes through which the pin can be selectively inserted so that the height of the lift module relative to the platform can be varied as required. In addition, this feature facilitates assembly of the lift module and platform in that the lift module can be placed so that the pin rests in the bottom of the notch, thereby bringing the fastener holes of the lift module into alignment with a corresponding fastener holes of the lift support. The quick release pins or bolts can then be inserted through the aligned holes to secure the lift module.

Figure 12:
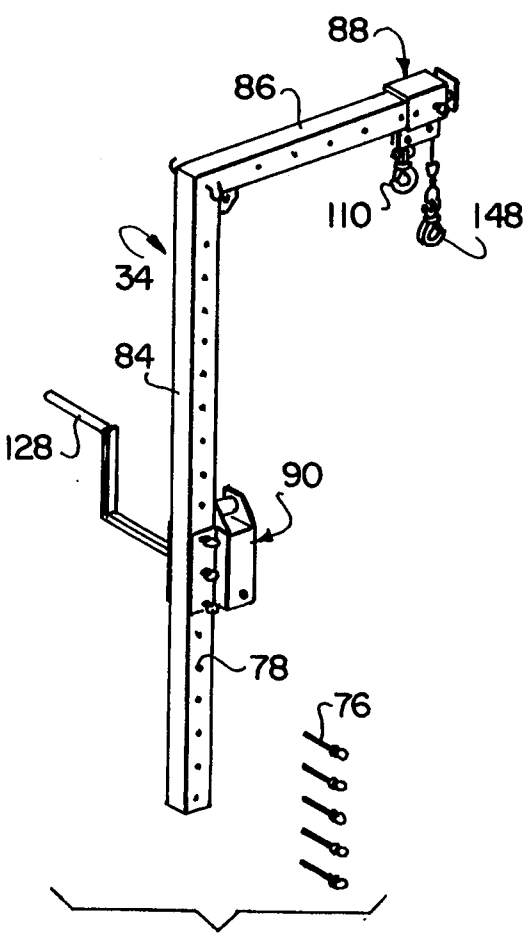
FIG. 12 is a perspective view from the rear of the lift module of FIG. 6.

FIG. 5 illustrates a modified embodiment having lift supports 70, 70′ are provided with a plurality, shown as four, of notches 72 together with a pair of aligned fastener holes 74. This facilitates assembly of the lift module in four positions of different elevations relative to the platform. Thus, the lift module can be assembled so that the quick release pin seats into the lowermost pair of notches for the lowest selected elevation. In any of the four notch positions, the fastener holes and the lift supports are in alignment with at least a pair of holes in the lift module shown in FIG. 12. The exploded view of the FIG. 12 illustrates the fastener bolts 76, which could also be quick release pins, which are inserted through the fastener holes 78 of the lift module.

Chassis 48 is comprised of a pair of horizontal beams 80, 80' rigidly connected with a transverse beam 82. Each horizontal beam mounts a front caster and a rear wheel. Suitable braking mechanisms, not shown, may be attached on the chassis near the rear wheels for stopping movement of the mobile platform.

Details of lift module 34 are shown in FIGS. 6–12. The lift module is comprised of a vertical lift post 84 to which a horizontal boom 86 is attached at the top, together with a traveling carriage 88 and hoist mechanism 90. Both the boom and lift post are preferably made with box-shaped cross-sections for strength. A pair of gusset plates 92 are rigidly connected at the juncture of the boom and lift post, also for strengthening purposes. A stopper plate 94 is mounted at the distal end of the boom for preventing the carriage from running off the boom. At the proximal end of the boom, utility hooks 96 are rigidly attached to each boom side wall for purposes of carrying accessory items such as I.V. bottles, plasma bags and the like.

Figure 7:
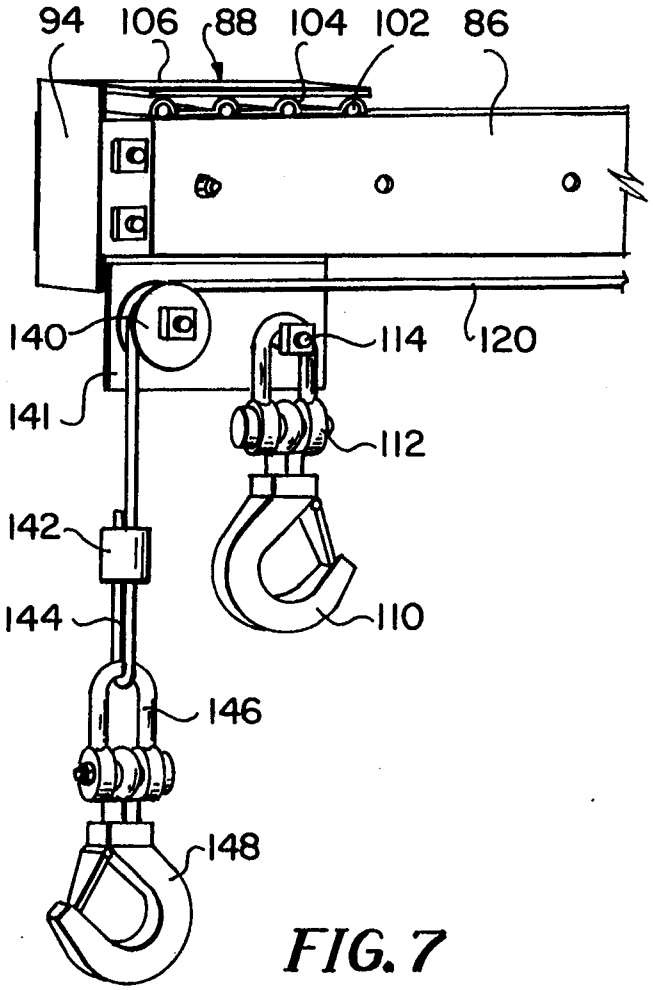
FIG. 7 is a fragmentary perspective view to an enlarged scale showing details of the lift module of FIG. 6.
Figure 9:
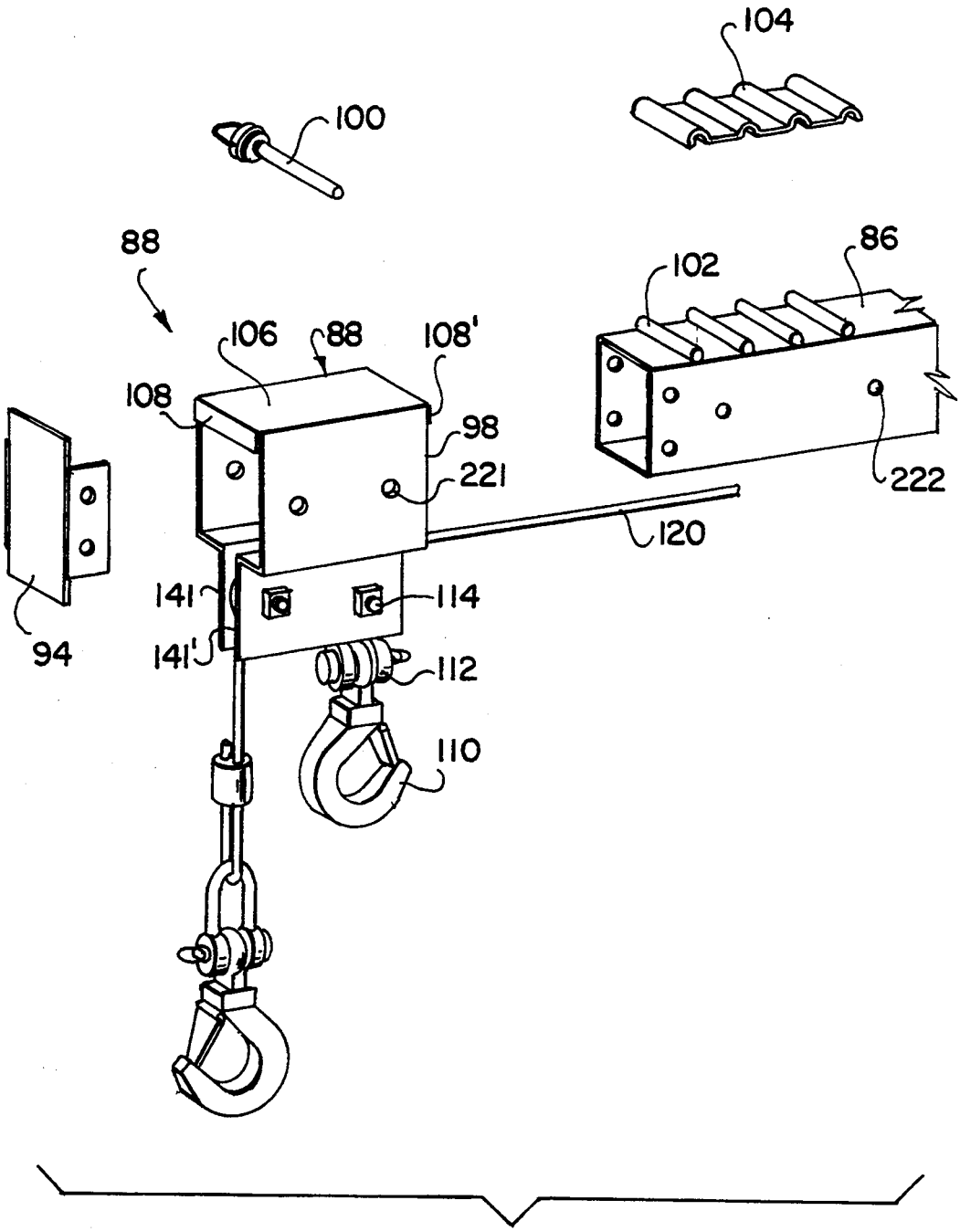
FIG. 9 is an exploded perspective view of the components shown in FIG. 7.

The carriage 88 is illustrated in detail in FIGS. 7 and 9 and comprises a rigid housing 98 which is releasably attached to the boom by means of a quick release pin 100. The weight of the carriage is supported on the top of the boom by means of a series of roller bearings 102 mounted in a bearing cage 104. The top plate 106 of the carriage housing is supported on the top of the bearing cage. Downwardly turned front and rear flaps 108, 108' at the top of the housing retain the bearing cage within the carriage.

At the lower aft end of the carriage, a fixed hook 110 is suspended on an aft shackle 112 which in turn is hung on the carriage with a bolt 114.

Figure 11:
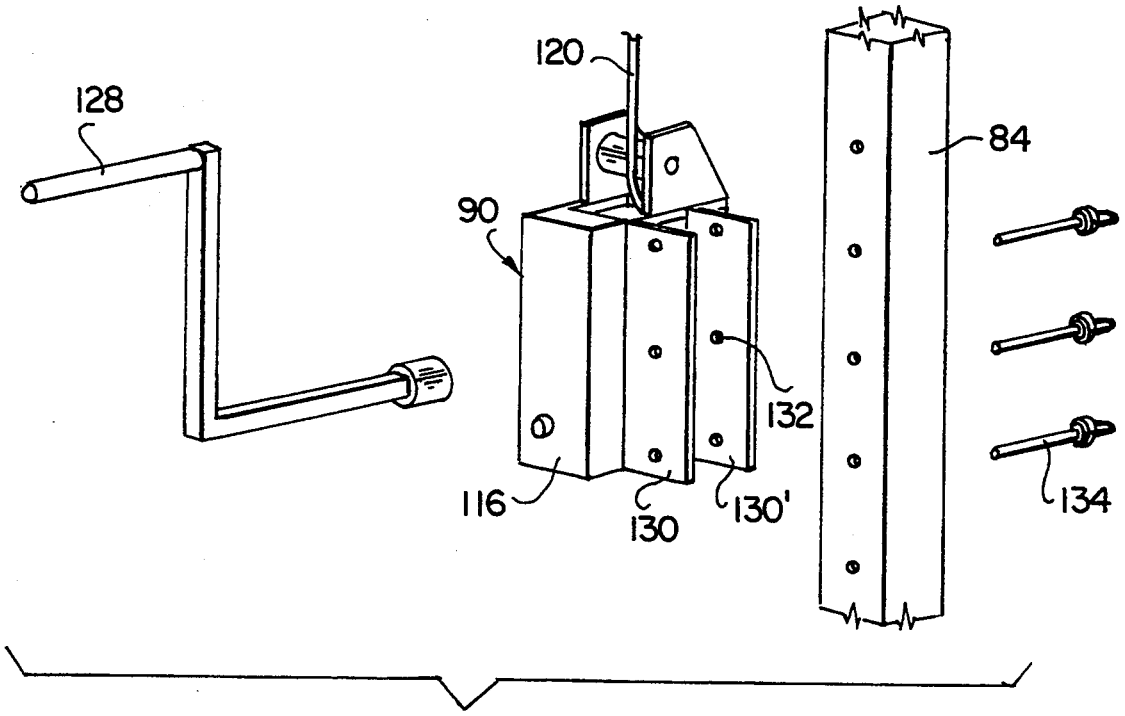
FIG. 11 is a fragmentary exploded perspective view of the components shown in FIG. 10.
Figure 10:
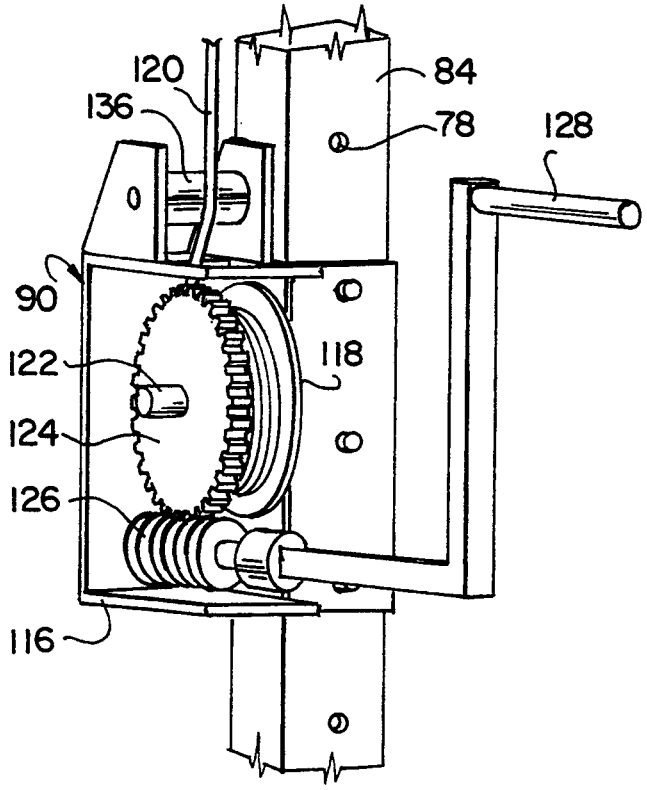
FIG. 10 is a fragmentary perspective view showing details of components of the winch box for the lift module of FIG. 6.

Hoist mechanism 90 of the lift module is illustrated in detail in FIGS. 10 and 11. The hoist mechanism is comprised of a winch box 116 which has a drum 118 on which a wire rope 120 is reaved. The drum is keyed on a rotatable axle 122. In FIG. 10 the front wall of the winch box is not shown for purposes of clarity. The axle carries a worm gear 124 which meshes with a worm 126. The worm is rotatably mounted at the lower end of the winch box and is turned by means of a crank 128. The crank can be used to turn the worm at either the left or right hand end of the worm shaft. The winch box is provided with a pair of mounting plates 130, 130' through which pairs of vertically spaced fastening holes 132 are bored. The winch box can be moved vertically to the desired position where the holes are in alignment with the corresponding fastener holes 78 in the lift post. Fastener bolts 134 are then inserted through the aligned holes to secure the winch box in place.

Wire rope 120 is trained from the drum upwardly through an opening in the top of the winch box and across a roller 136. The wire rope is then trained through a 90° angle around an aft pulley 138 (FIG. 8) which is mounted between gusset plates 92. The wire rope is then trained forwardly along the boom through the carriage and around a front pulley 140. The front pulley is rotatably mounted between a pair of plates 141 and 141' which are integral with and extend downwardly from carriage housing 98. The front pulley directs the wire rope through a 90° downward direction. The distal end of the rope is bent back upon itself and secured by a clip 142 to form an end loop 144. A shackle 146 is suspended by the end loop, and a front hook 148 is attached to the shackle.

To lift up or lower a patient who is suspended on the front hook, the caregiver turns the crank to rotate the worm which in turn rotates the worm gear and drum. The worm gear is preferably non-reversible; i.e., the lead angle of the worm is less than approximately 10°. As a result, the wire rope drum cannot be turned by the weight of the patient suspended on the front hook. The only way that the patient can be moved up or down is by turning the crank. This safety feature prevents accidentally dropping the patient.

Using the transport chair 38 as the patient's support module installed on mobile platform 32 as shown in FIG. 1, the combined assembly can be used as a wheelchair. With the lift module 34 attached to the mobile support, the assembly has a number of advantages over ordinary wheelchairs. For example, a heavy invalid patient can be easily transferred from a bed to the seat of an automobile or to an operating table. With prior art procedures, both a mechanical lift and a separate wheelchair would be required to perform this task.

Figure 14:
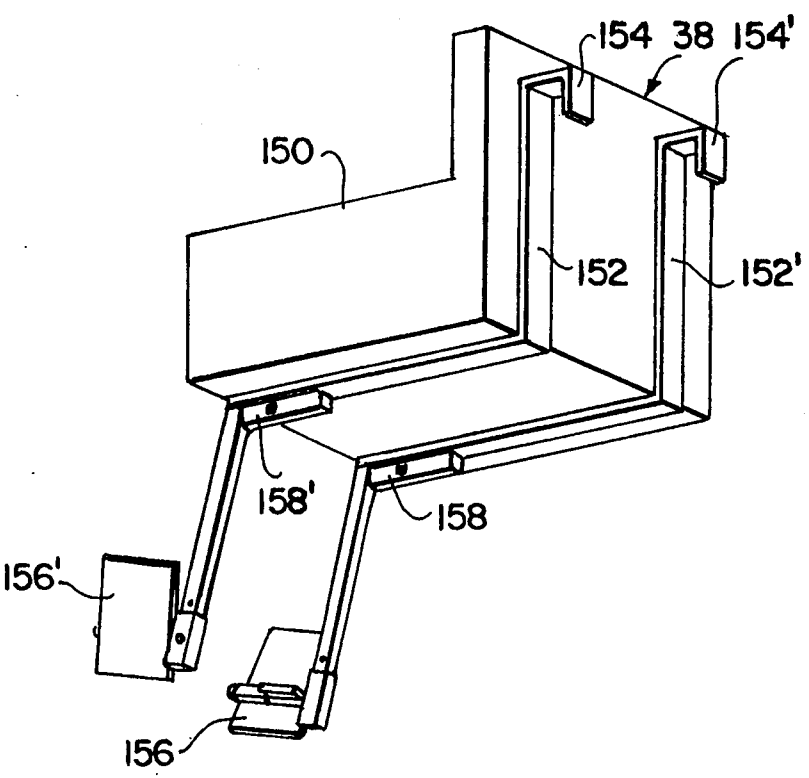
FIG. 14 is a perspective view from the rear of the chair of FIG. 13.
Figure 13:
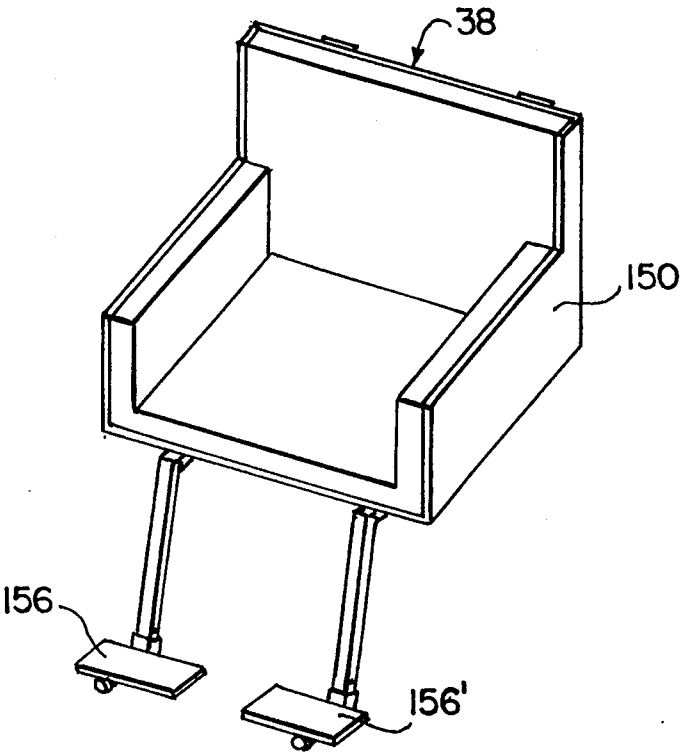
FIG. 13 is a perspective view of the patient support module chair shown in FIG. 1.
Figure 15:
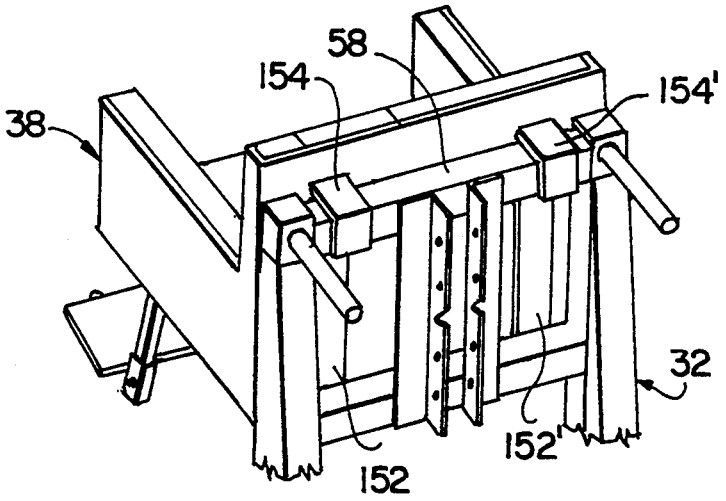
FIG. 15 is a fragmentary perspective view illustrating attachment of the chair of FIGS. 13 and 14 to the mobile platform of the apparatus of FIG. 1.

Details of support module chair 38 are illustrated in FIGS. 13 and 14. The chair has a rigid outer shell 150, and preferably the seat, back and insides are padded with cusions for comfortable seating. A pair of L-shaped support brackets 152, 152' are attached to the back of the outer shell. The upper ends of the brackets are provided with U-shaped hooks 154, 154' which are adapted for hanging on the top horizontal bar 58 of mobile platform 32 (FIG. 15). A pair of removable footrests 156, 156' are inserted into sockets 158, 158' below the chair. Each footrest is pivotally mounted between the horizontal position of FIG. 13 for resting the patient's feet and the vertical position of FIG. 14 which permits egress to and from the chair.

Figure 18:
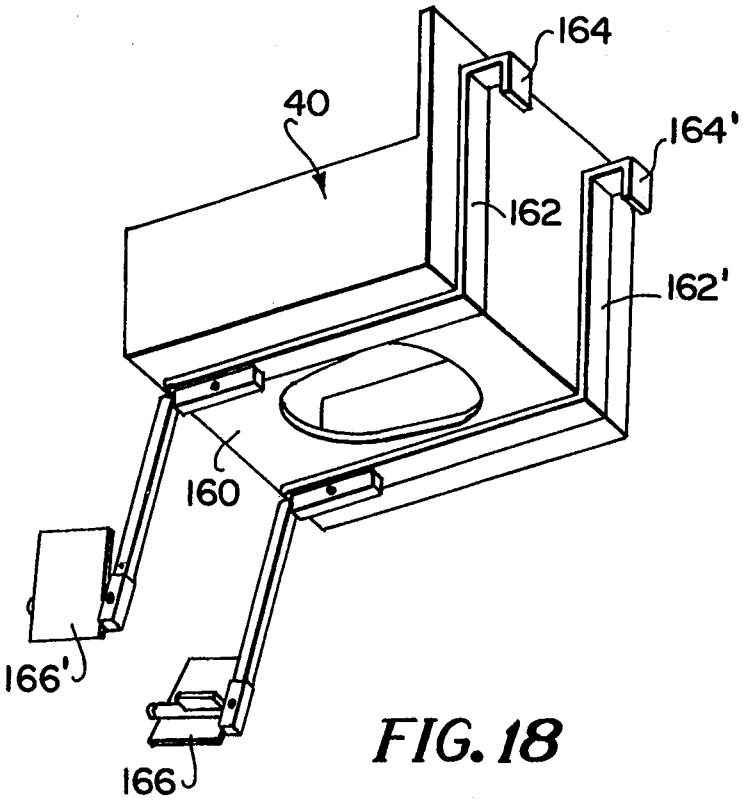
FIG. 18 is a perspective view from the rear of the commode seat of FIG. 17.
Figure 17:
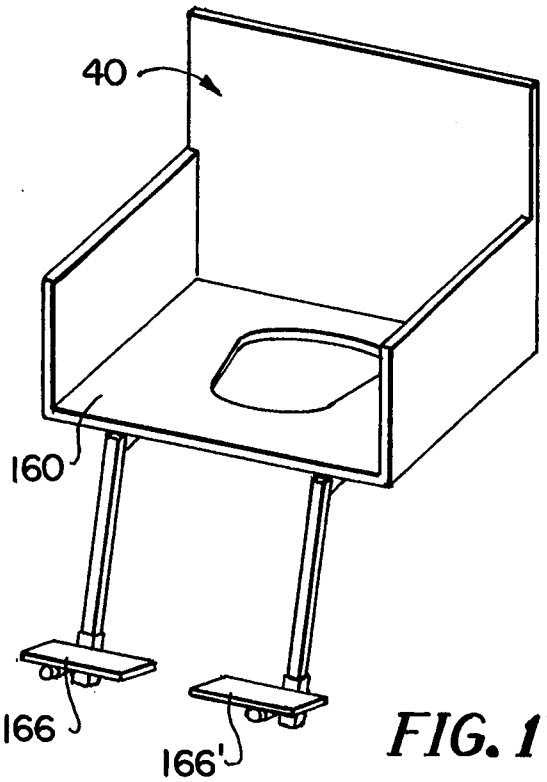
FIG. 17 is a perspective view of the commode seat shown in FIG. 16.
Figure 19:
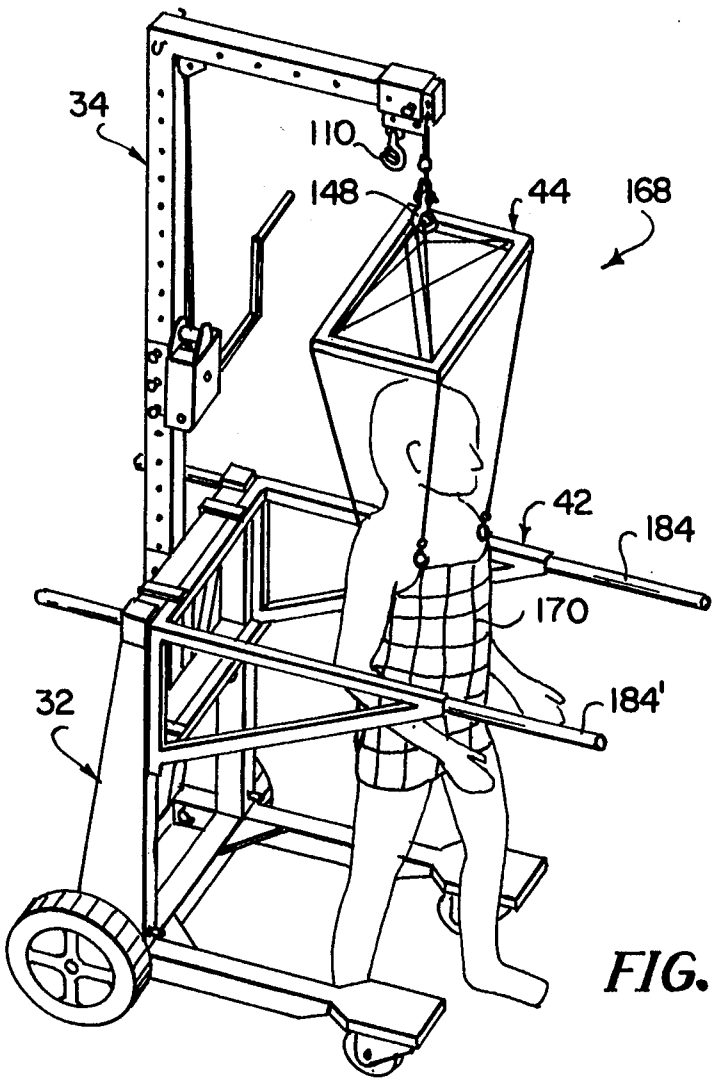
FIG. 19 is a perspective view of apparatus according to another embodiment providing a suspension frame for supporting the patient upright together with a handle frame mounted on the mobile platform.

Details of commode chair 40 are illustrated in FIGS. 17 and 18. The chair is comprised of a seat 160 shaped in a toilet-seat fashion. A pair of L-shaped support brackets 162, 162' are mounted to the backside of the chair, and the support brackets have U-shaped hooks 164, 164' for attachment to the horizontal bar of the mobile platform in the manner explained in connection with the embodiment of FIG. 14. Pivotal footrests 166, 166' are also mounted below the commode chair. In the use of this embodiment, the caregiver hoists the patient off the bed utilizing the lift module. The commode chair is then attached to the mobile platform. A commode (not shown) is then placed under the chair hole to collect the patient's waste. Alternatively, the caregiver can transport the patient to a toilet by moving the mobile platform. With the seat of a toilet in the up position, the toilet will fit between the two horizontal beams of the mobile platform and beneath the commode chair. This permits the patient to empty waste directly into the toilet while sitting on the commode chair. It saves the trouble of transferring the patient from a wheelchair to a toilet seat and vice versa, and also avoid the trouble of washing a commode.

Other types of interchangeable seats, for example shower chairs having nets on rigid frames, can be provided for the support module chair. For extra heavy patients, the chair foot rest posts and the L-shaped support brackets are of one-piece integral construction. The integral foot rest posts and support brackets would be supported by the chassis at the bottom and would also be supported at the top of the vertical frame of the mobile platform.

FIGS. 19–21 illustrate an embodiment providing apparatus 168 adapted for use as a therapeutic walking exerciser or as a standing-aid. In this embodiment, the patient's support module comprises a body harness 170 carried by suspension frame 44 which in turn is attached to the front hook 148 of lift module 34. A handle frame 42 is mounted on the mobile platform with the transport or commode chair removed. The body harness preferably is of a flexible fabric sized and proportioned for supporting under the patient's armpits and crotch area. Suspension frame 44 is comprised of a rigid rectangular frame 172 having lower cables 174 suspended from the four corners. The lower ends of the cables are attached to utility snap hooks 176 which releasably connect with the upper parts of the harness. Four upper cables 178 are connected to the rigid frame and are attached together at the top to a loop 180 which is suspended from the front hook of the lift module. The body harness will prevent the patient from falling while in a standing position. Any suitable type of conventional body harness can be used with the invention.

Figure 22:
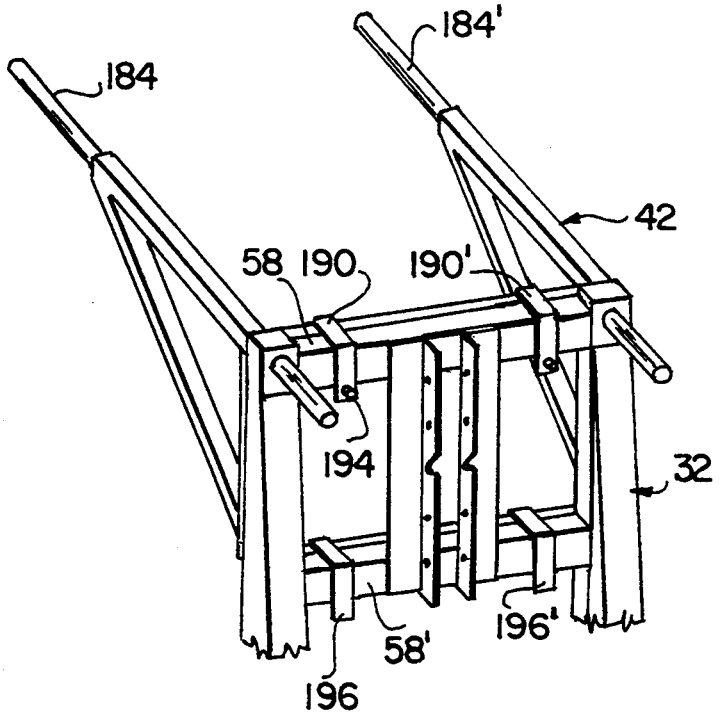
FIG. 22 is a perspective view showing the arrangement for attaching the handle frame of FIG. 21 to the mobile platform which is a part of the apparatus of FIG. 19.

Handle frame 42 is shown in detail in FIGS. 19 and 21 and is comprised of a pair of rigid triangular frames 182, 182', each of which has a front grip handle 184, 184' The two triangular frames are connected together by upper and lower beams 186 and 188. The upper beam mounts a pair of U-shaped brackets 190, 190', the arms of which are formed with holes 192 for the insertion of quick release pins 194 (FIG. 22). The lower beams also mounts a pair of U-shaped brackets. The handle frame is detachably mounted to the mobile platform in the manner shown in FIG. 22. The frame is moved down until upper brackets 190, 190' slip over the upper horizontal bar 58 of the mobile platform while the lower brackets 196, 196' slip over the lower horizontal bar 58'. Quick release pins 194 are then fitted through the aligned openings in the upper brackets to secure the handle frame in place.

With handle frame 42 installed, the patient can use it for keeping his balance, supporting himself while walking or standing, or for pulling the mobile platform along while walking forward. The caregiver utilizes lift module 34 to suspend the patient above the floor. The patient is then lowered until his feet touch the ground and support part of his own weight. The patient's remaining weight is supported by the lift module.

The caregiver can raise or lower front hook 148 to adjust the distance of the patient from the floor and to control the amount of the patient's body weight supported on his feet. Likewise, by pushing down on the grip handles 184, the patient can adjust the amount of body weight that is supported on his own feet. For therapeutic walking exercise, the caregiver can push the platform forward while following a patient. The patient can then walk with his own feet, supporting only part of his weight. The advantages to this are, first, the danger of the patient falling down is completely avoided, second, the patient can easily control the amount of his body weight supported on his feet, third, it considerably lessens the amount of work and attention from the therapist so that the therapist can handle several patients simultaneously, and fourth, the walking therapy becomes safe and easy such that it can be conducted at home with less involvement from the therapist, thereby reducing treatment costs.

Figure 23:
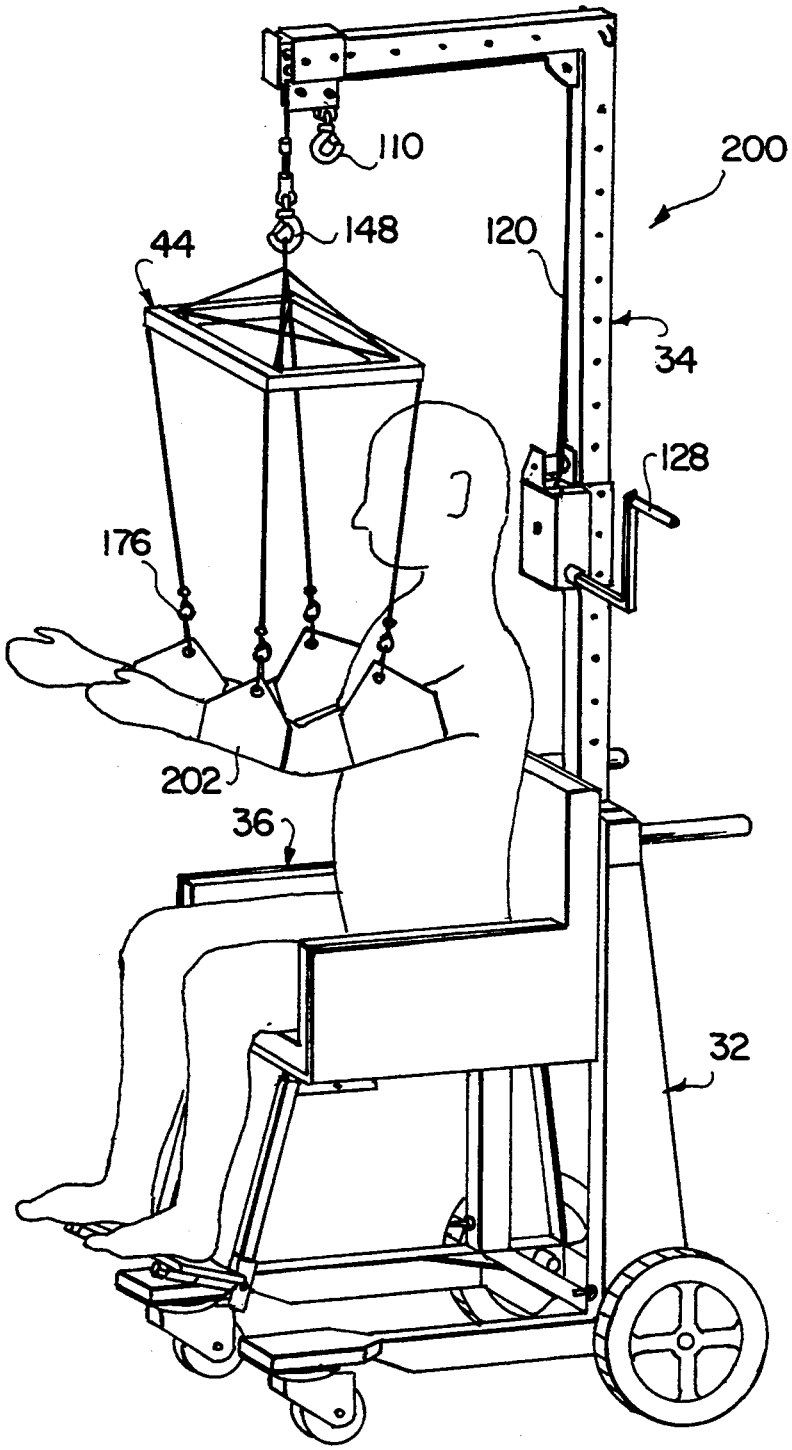
FIG. 23 is a perspective view illustrating apparatus according to another embodiment providing a suspension frame which carries arm slings that provide support under the patient's arms.

FIG. 23 illustrates apparatus 200 in accordance with an embodiment of the invention providing hand-arm therapeutic exercise. The support module chair 36, lift module 34 and mobile platform 32 of the embodiment of FIG. 1 are first mounted together. The suspension frame 44 of the embodiment of FIGS. 19–20 is then hung on front hook 148 of the lift module. Arm slings 202 are then secured to the utility snap hooks 176.

In the operation of hand-arm exerciser apparatus 200, the patient sits in the chair and his arms are placed into the slings 202. As desired, the legs can be placed in the slings for exercise. The caregiver operates the winch to raise and lower the front hook to move the patient's hands and arms up and down. The electrically power lift module 204 of FIG. 24 can be used, as desired. In such case, a suitable electric foot switch, not shown, can be employed for use by the patient to operate up and down movement of the front hook. This reduces the therapist's time and effort.

Figure 24:
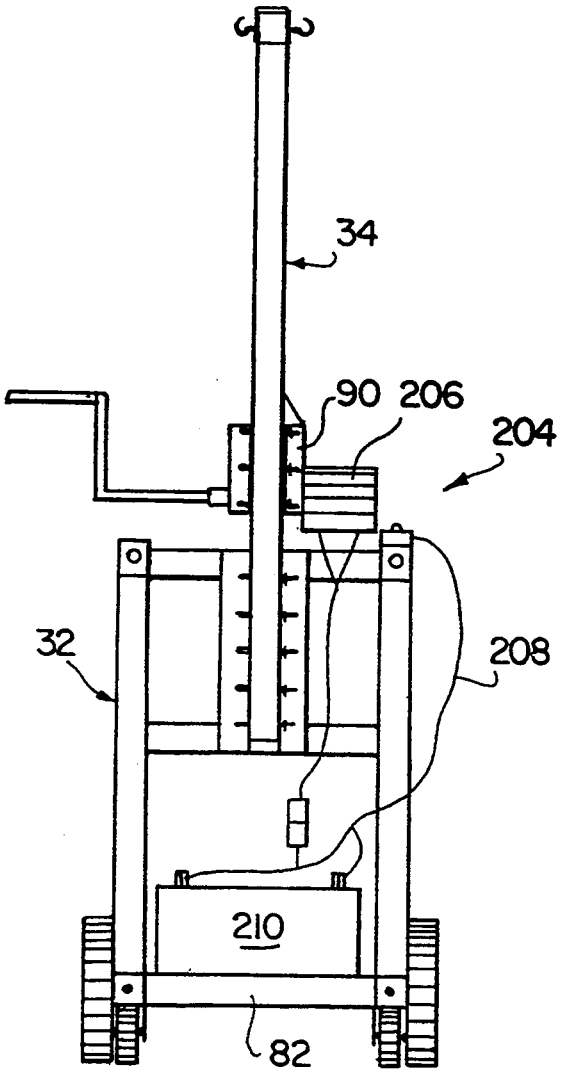
FIG. 24 is a rear elevational view of apparatus according to another embodiment which includes electrically-powered motor for actuating the lift module.

FIG. 24 illustrates apparatus according to an embodiment providing the electric-powered lift module 204. A lift module 34 in accordance with that shown in FIGS. 6–12 is modified by attaching an electric motor 206 to the side of winch box 116 with the motor connected to rotate the end of worm 126. The motor is powered through cables 208 connected with a battery 210 mounted on the top of transverse beam 82 of the mobile platform. A conventional electrical control, not shown, is used to control operation of the motor. When the lift module is removed from the lift platform, power cables 208 are disconnected. Also, when the electric system is utilized, the crank 128 is removed from the winch box.

The method of operation and use of the invention for transferring a patient from a bed 212, automobile seat or other support structure into the support module chair 36, or support module commode, as required, is illustrated in FIGS. 25–28. The method of transferring the patient from the chair or commode to the bed, automobile seat or other support structure is the reverse of the following steps. The patient is first arranged in a seating or supine position on the bed. An appropriate sling 214 is then placed under the patient, with the sling suspended from a yoke 216. The yoke is provided with a short loop 218 and a long loop 220, both of which are adapted to be releasably connected with the front and rear hooks 148 and 110, respectively, of the lift module.

Figure 25:
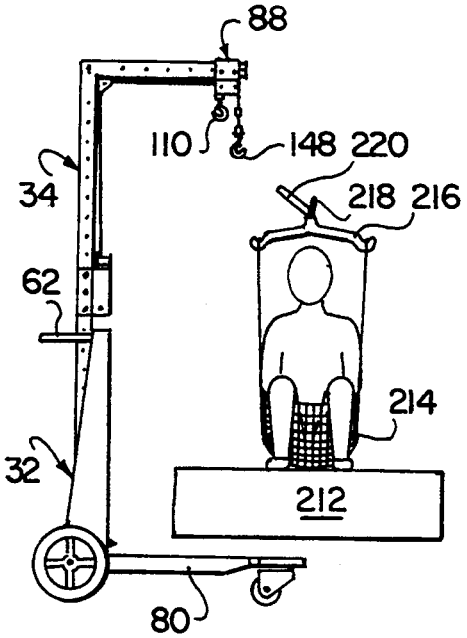
FIG. 25 is a side elevational view showing the apparatus of FIG. 1 with the support module chair removed and illustrating one step of a procedure using a sling for lifting a patient from a bed or other structure.
Figure 26:
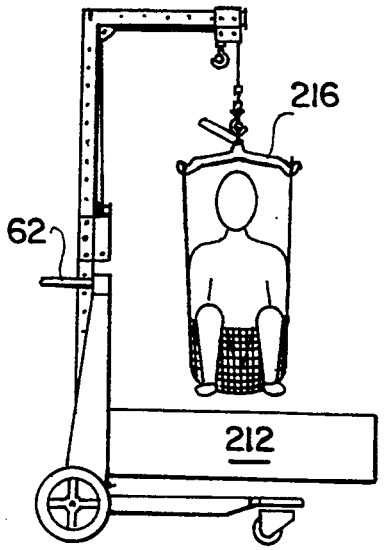
FIG. 26 is a side elevational view of the apparatus of FIG. 25 showing another step in the procedure.
Figure 27:
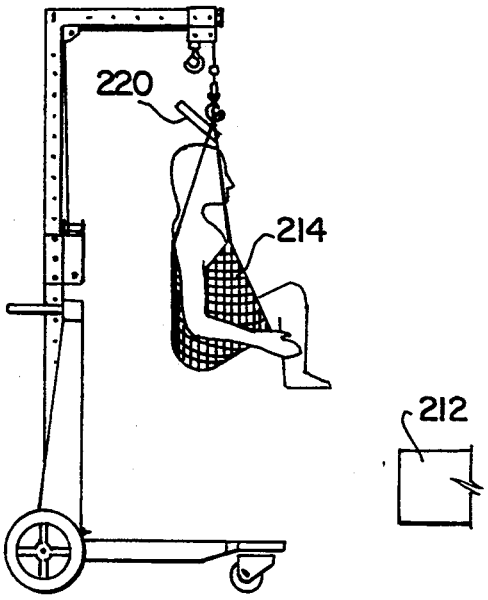
FIG. 27 is a side elevational view of the apparatus of FIG. 25 illustrating another step in the procedure.

With the support module chair removed, mobile platform 32 with lift module 34 attached is moved so that the front hook 148 is over the bed centered on patient's center of gravity. As shown in FIGS. 25 and 26, the absence of the chair permits the horizontal beams 80 of the platform to move underneath the bed, which would not be possible with a conventional wheelchair. Quick release pin 100 (FIG. 9) is then inserted through holes 221 in carriage 88 aligned with holes 222 in the boom to lock the carriage to the boom, preventing the carriage from moving. Crank 128 is then turned so as to lower the front hook to which small loop 218 of the yoke is attached. The crank is then turned back to raise the front hook and slowly raise the patient. Once the patient is lifted off the bed, he is turned 90° to face the forward direction of the platform, as shown in FIG. 27. The platform is then pulled away from the bed. The crank is then turned to pull the patient higher until the large loop 220 can be hung on fixed hook 110 of the carriage. The crank is then turned to lower the patient through the length of the long loop so that the patient's weight is supported by the fixed hook. The crank is again turned to lower the front hook further to release all tension in the wire rope. Otherwise it would be difficult to take the quick release pin out of the carriage.

In the next step the desired support module chair 36 or commode chair is attached to the mobile platform.

Figure 28:
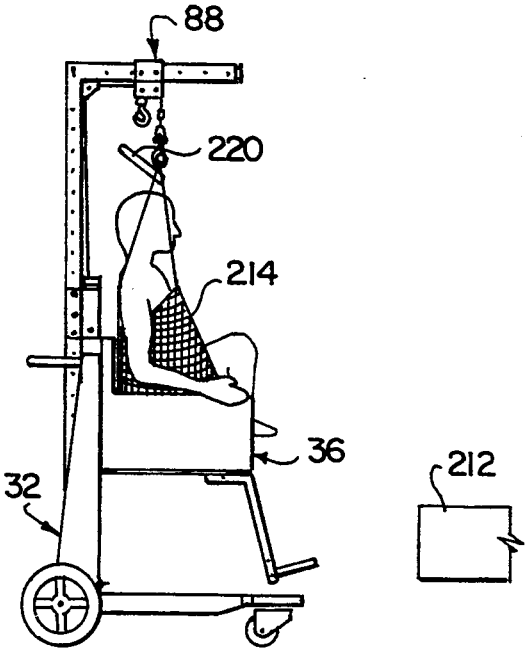
FIG. 28 is a side elevational view of the apparatus of FIG. 25 illustrating yet another step in the procedure.

The quick release pin is removed from the carriage, and the caregiver then moves the carriage and patient backward to a position above the chair, as shown in FIG. 28. The quick release pin is then re-inserted into the carriage to fix the carriage at its rearmost location. The crank is turned to move the front hook upwardly so that the patient's weight is transferred gradually from the fixed hook back to the front hook. At the time the patient's weight is completely supported by the front hook, the large loop 220 of the yoke can be removed from the fixed hook. The patient is then lowered back to the chair, and the yoke and sling are then removed, as necessary.

The above procedure can be used to transfer a patient sitting on a seat inside an automobile to a bed inside a building, and vice versa, by using only the single apparatus, which is not the case with conventional apparatus. This is achieved in the invention because first, the height of the boom can be easily adjusted, second, the boom can be moved inside the automobile to raise or lower the patient, third, the chassis is low enough to be pushed under the automobile, fourth, the vertical frame, with the chair removed, can be pushed all the way forward until it touches the side of the automobile, and fifth, the patient can be immediately placed into the chair for transportation without transferring to another wheelchair.

If the patient is not heavy, and can be moved to the edge of a bed easily, the procedure can be simplified. After placing the patient at the edge of the bed, the carriage is moved back over the center of gravity of the patient. The carriage is then locked with the quick release pin. The patient is then put in a sling and suspended from the front hook. The rest of the operation is similar to that explained for FIG. 28.

It will be seen from the foregoing that the invention provides apparatus which is modular, simple and economical to build, as well as easy to use and maintain. Thus, the entire mobile platform is held together by only four quick release pins. The winch of the hoisting mechanism is attached to the lift post with quick release pins. In turn, the lift post is mounted on the mobile platform with quick release pins. By removing these pins, the assembly can be converted into separate modules and can be placed easily into a truck or car. Also, the support module chair can be easily hooked onto the mobile platform. As a result, it is easy to assembly or dismantle the device by unskilled people without the requirement for special tools. When disassembled, the parts occupy very little storage space and are convenient for transportation. The parts can also be dismantled easily for cleaning. The invention therefore provides a low-cost device that is affordable to poor people worldwide.

What is claimed is:

1. A system of apparatus for use in assisting a handicapped or disabled patient with transportation, sanitation or therapy procedures, the system comprising the combination of mobile platform means for movement over a floor or other surface, patient support means for supporting the patient, lift module means for lifting and lowering the patient relative to the support means, mounting means for mounting the lift module means on the platform means, attachment means for attaching or detaching the support means to the platform means whereby with the support means removed the platform means is enabled for movement into close relationship with a bed or other structure for positioning the lift module means relative to the bed or other structure for lifting or lowering the patient from or to the bed or other structure.

2. A system of apparatus as in claim 1 in which the patient support means comprises a chair.

3. A system of apparatus as in claim 1 in which the patient support means comprises a commode seat.

4. A system of apparatus as in claim 1 for use as a therapeutic exerciser in which the patient support means comprises handle frame means having grip handles oriented at a position for the patient to grasp while standing adjacent the platform means.

5. A system of apparatus as in claim 4 for use as a therapeutic walking exerciser or standing-aid in which the patient support means further comprises body harness means for providing support under the patient's armpits and crotch to hold the patient substantially upright whereby the patient can grasp said handles while being supported by the body harness means and means for suspending the body harness means from the lift module means.

6. A system of apparatus as in claim 1 for use as a therapeutic walking exerciser or standing-aid, the apparatus further comprising body harness means for providing support under the patient's armpits and crotch to hold the patient substantially upright, and means for suspending the body harness means from the lift module means.

7. A system of apparatus as in claim 1 for use as a hand-arm or legs exerciser, the apparatus further comprising body sling means for providing support under the patient's arms to hold said arms out in front of the patient while the support means is attached to the platform means and the patient is sitting therein to enable exercise of the patient's hands and arms, and means for suspending the body harness means from the lift module means.

8. A system of apparatus as in claim 7 in which said means for suspending the body sling means comprises a substantially rigid suspension frame carried by the lift module means, together with cables connected between the body harness means and suspension frame.

9. A system of apparatus as in claim 1 for use with a sling which carries the patient for movement between the bed or other structure and the support means, further characterized in that the lift module means comprises a boom having an arm, means for supporting the boom on the platform means with the arm extending over the position occupied by the patient support means and hoist means carried on the boom for releasably connecting to the sling and for raising and lowering the sling with the patient carried therein.

10. A system of apparatus as in claim 9 and further characterized in that the hoist means includes a flexible cable having a distal end and a proximal end, movable hook means attached to the cable distal end for releasably connecting with the sling, and winch means connected to the cable proximal end and operable for reeling the cable distal end upwardly and downwardly from the boom arm to thereby move the hook means and sling connected thereto upwardly and downwardly with the patient carried in the sling.

11. A system of apparatus as in claim 10 and further characterized in that the hoist means includes a carriage mounted for back and forth movement on the boom arm between an extended position for lifting or lowering the patient from or to the bed or other structure and a retracted position for lifting or lowering the patient from or to the support means, said winch means is further operable for reeling in the cable distal end through a first length of travel to a position where the movable hook means engages with the carriage when the latter is in said extended position, and the winch means is still further operable for reeling in the cable distal end through a second length of travel to thereby move the carriage along the boom arm to said retracted position.

12. A system of apparatus as in claim 11 and further characterized in that said hoist means includes fixed hook means attached to the boom arm for releasably connecting with the sling to permit transfer of the sling to and from the movable hook means.

13. A system of apparatus as in claim 1 and further characterized in that said patient support means comprises a chair and a commode seat, and said attachment means includes means for interchangeably attaching a selected one of the chair or commode seat to the platform means.

14. A system of apparatus as in claim 1 and further characterized in that said patient support means comprises a chair, a commode seat, and handle frame means having handles positioned for the patient to grasp while standing adjacent the platform means, and said attachment means includes means for interchangeably attaching a selected one of the chair, commode seat or handle frame means to the platform means.

15. A system of apparatus as in claim 1 and further characterized in that said patient support means comprises a chair, a commode seat, handle frame means having grip handles positioned for the patient to grasp while standing adjacent the platform means and body harness means for providing support under the patient's armpits and crotch to hold the patient substantially upright, said attachment means includes means for interchangeably attaching a selected one of the chair, commode seat or handle frame means to the platform means of said body harness means to the lift module means.

16. A method of moving a handicapped or disabled patient to or from a bed or other structure through the use of a patient support carried by a mobile platform which mounts a lift mechanism having a boom arm and a movable lift hook carried on the boom arm, the method comprising the steps of supporting the patient in a sling while the patient is over the bed or other structure, attaching the sling with the patient supported therein to the lift hook while the boom arm is extended, lifting the sling and patient therein upwardly, temporarily securing the sling to the lift mechanism while detaching the sling from lift hook, retracting the boom arm to a position where the sling is substantially over the patient support, attaching the sling to the movable lift hook, and lowering the lift hook and sling until the patient is seated on the patient support.

17. A method as in claim 16 and further comprising the steps of detaching the patient support from the mobile platform to permit the platform to be moved to a position where the boom arm is over the patient on the bed or other structure, and reattaching the patient support to the mobile platform when the boom arm is retracted to permit the sling and patient to be lowered onto the support.

* * * * *